United States Patent [19]

Siebert

[11] 4,128,902

[45] Dec. 12, 1978

[54] PROTECTIVE GYMNAST PANTS

[75] Inventor: Gary R. Siebert, Wyomissing, Pa.

[73] Assignee: Gym-Kin Inc., Sinking Spring, Pa.

[21] Appl. No.: 823,190

[22] Filed: Aug. 9, 1977

[51] Int. Cl.[2] ..... A41D 13/00

[52] U.S. Cl. ..... 2/2

[58] Field of Search ..... 2/2, 2.5, 228, 238, 2/406

[56] References Cited

U.S. PATENT DOCUMENTS 759,765 5/1904 Stall ..... 2/228

2,629,094 2/1953 Goldsmith ..... 2/2

*Primary Examiner*—Doris L. Troutman

*Attorney, Agent, or Firm*—William J. Ruano

[57] ABSTRACT

Injury protective pants to protect the pelvic hip and thigh area of the gymnast while learning various wrapping skills on uneven parallel bars. A pouch is provided on the inside of the front portion of the gymnast pants for receiving two layers of foam of different density to enable variable degrees of protection against injury of the thigh, hip or pelvic area.

2 Claims, 4 Drawing Figures

PROTECTIVE GYMNAST PANTS

This invention relates to protective pants for wear, particularly by a female gymnast, to protect the pelvic, hip and thigh area while learning various wrapping skills on the uneven parallel bars.

At the present time, as far as I am aware, there is no satisfactory protection provided for the gymnast while learning wrapping skills on parallel bars. Attempts have been made to provide protection by means of an elongated safety cushion that fits around each of the uneven parallel bars. However, such safety cushions are sometimes accidentially detached as a result of the wrapping action and no longer provide the desired protection. Moreover, the gymnast often will collide with other parts of the uneven parallel bars or other equipment, causing injury which sometimes is very serious.

An object of my invention is to provide a novel protective padded device that is worn by the gymnast to overcome the above named disadvantages of safety cushions that fit on these bars.

A more specific object of my invention is to provide a novel pouch containing cushioning means for protecting the pelvic, hip and thigh area of the gymnast's pants to cushion against injury while performing wrapping skills on the uneven parallel bars.

Other objects and advantages will become more apparent from the following description taken with the accompanying drawing wherein.

Figure 1:
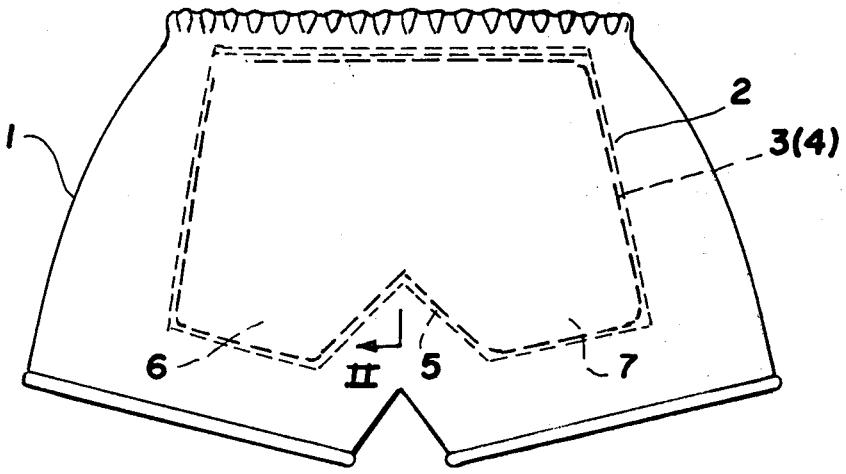
FIG. 1 is a front view of gymnast shorts embodying the present invention.
Figure 2:
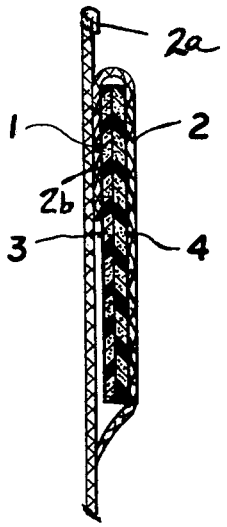
FIG. 2 is a cross-sectional view taken along line II—II of FIG. 1.
Figure 3:
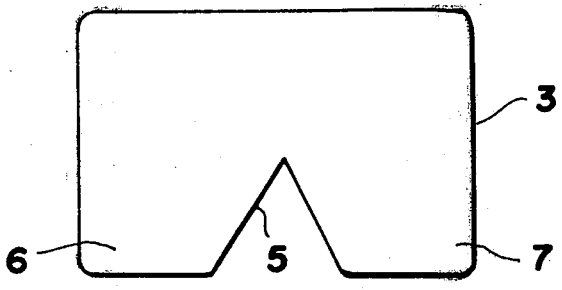
FIG. 3 is a plan view of one of the pads.

Referring more particularly to FIGS. 1 and 2, numeral 1 denotes a pair of female gymnast pants having, on the inside of the front portion thereof, a pouch 2 defined by an elastic containing top edge 2*a* of the pants for contracting the flap 2*b* folded over the mouth portion of the pouch so as to securely contain therein a pair of pads 3 and 4, of foam rubber or plastic, preferably of different density. For example, pad 3 could be a sheet of foam of high density whereas 4 could be a sheet of foam of low density. Each pad has leg portions 6 and 7 defined by a cut-out portion 5 at the crotch.

The pouch 2 has a perimeter of somewhat M-shaped outline so as to fully cover the pelvic, thigh and hip area of the gymnast. Of couse, a single pad or greater number than two may be used, instead, with different or the same densities as long as they are of satisfactory flexibility. The reasons for the placement of the pouch on the inside instead of the outside of the pants is to prevent any possibility of hooking the top edge 2*a* defining the opening on any object while performing wrapping skills.

In operation, in use when the gymnast first learns a new wrapping trick, he or she uses both foam pads 3 and 4 together to give maximum protection. As the gymnast increases skills in such performance, one of the pads is removed. Upon further increase of skill, perhaps the other pad of less density is used alone. After complete confidence is felt by both the gymnast and the coach, both pads may be removed. Flap 2*b* prevents accidental falling out of the pads. The pads, of course, will prevent injury to the hip, thigh or pelvic area. However, even in cases of a slight injury in these regions, the gymnast is protected from further injury and damage and reduction of pain is provided when colliding with the parallel bars.

Figure 4:
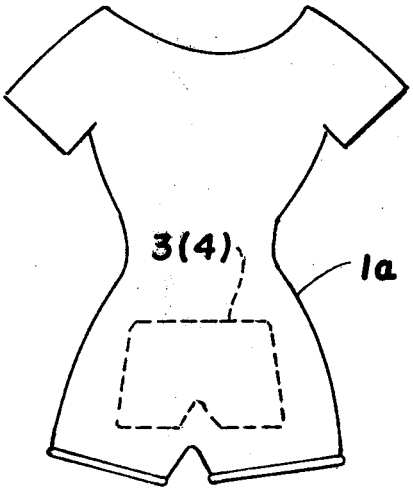
FIG. 4 shows a modification of the gymnast garment padded.

While padding of gymnast pants has been described, the interior padded pouch may be incorporated inside of leotards 1*a* (FIG. 4) instead which are used extensively by women. Of course, the protective pants described above may be worn over plain leotards.

Thus it will be seen that I have provided an efficient and highly effective protection against injury of the gymnast by building into the gymnast's pants padding that may be varied in amount simply by removing one of a plurality of pads of varying density; furthermore, I have provided a pouch on the inside of such pants to protect it from catching onto uneven parallel bars or other gymnasium equipment.

While I have illustrated and described a single specific embodiment of my invention, it will be understood that this is by way of illustration only and that various changes and modifications may be contemplated in my invention and within the scope of the following claims.

I claim:

1. A pair of gymnast pants having a pouch atttached to the inside of the front portion of the pants and having a perimeter encompassing only the pelvic, hip and thigh area of the gymnast, and padding means comprising a plurality of flexible, elastic foam cushions enclosed in said pouch for protecting the gymnast against injury while learning wrapping skills on uneven parallel bars or the like, said pouch including a flap wrapped around the top ends of said cushions for insuring their retention in the pouch while allowing ready withdrawal and reinsertion of selected cushions in said pouch.

2. A pair of pants as recited in claim 1 wherein said padding means comprises a plurality of foam rubber cushioning pads of different densities.

* * * * *